United States Patent [19]

Shanks, Jr.

[11] Patent Number: 4,485,496

[45] Date of Patent: Dec. 4, 1984

[54] ARTICLE OF APPAREL

[76] Inventor: Ralph Shanks, Jr., 4112 Candlenut La., Dallas, Tex. 75234

[21] Appl. No.: 426,765

[22] Filed: Sep. 29, 1982

[51] Int. Cl.[3] ..... A41D 27/20

[52] U.S. Cl. ..... 2/247; 24/119

[58] Field of Search ..... 2/247, 248, 249, 252; 150/47, 40; 224/219; 24/119, 117, 118

[56] References Cited

U.S. PATENT DOCUMENTS 3,122,805 3/1964 Hakim ..... 24/119
3,611,444 10/1971 Rector ..... 2/247
4,332,284 6/1982 Pallis ..... 150/40
4,404,689 9/1983 DeWan ..... 2/247

*Primary Examiner*—Doris L. Troutman
*Attorney, Agent, or Firm*—Andrew M. Hassell

[57] ABSTRACT

A detachable article such as a pocket adapted for attachment/detachment to/from an article of clothing such as a shoe, shorts, or a shirt, the article having two major faces on each of which is disposed attachment material so that either major face may be in engagement with the article of clothing, and providing for attachment to the remaining major face of a cover which may be plain or ornamental at the choice of the user.

10 Claims, 8 Drawing Figures

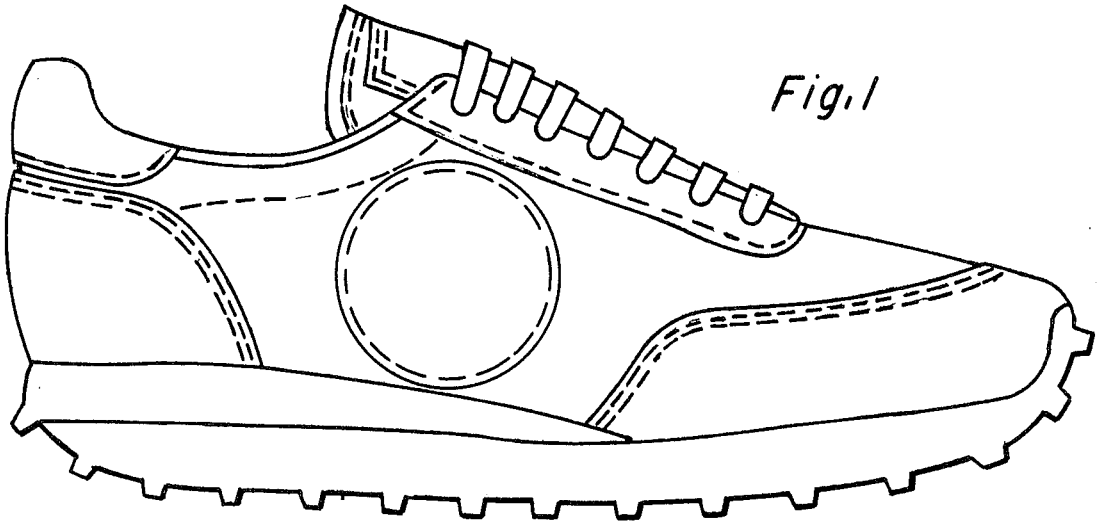
Fig. 1
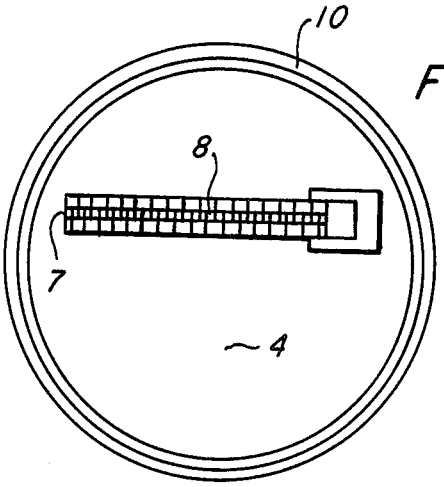
Fig. 2
Fig. 3
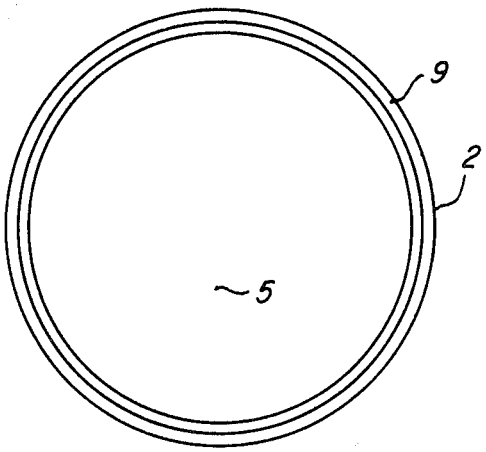
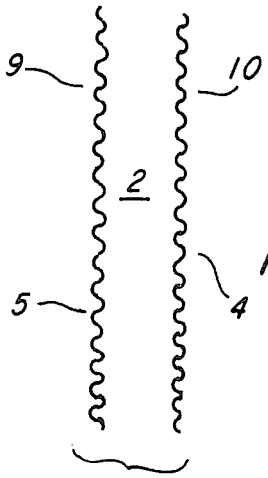
Fig. 4

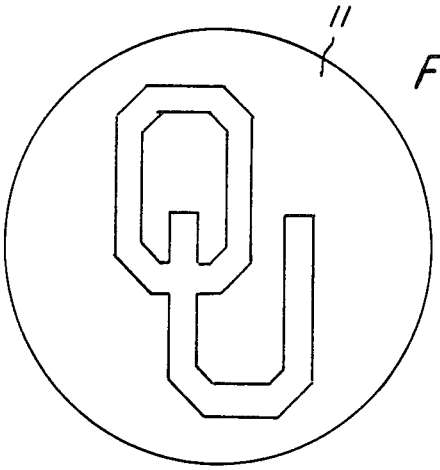
Fig. 5
Fig. 6
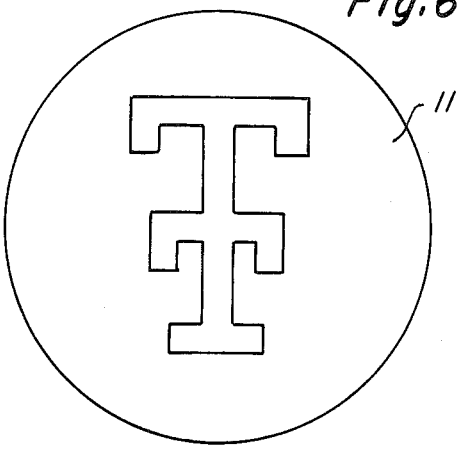
Fig. 7
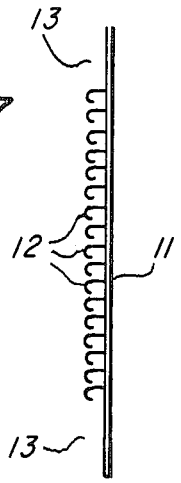
Fig. 8
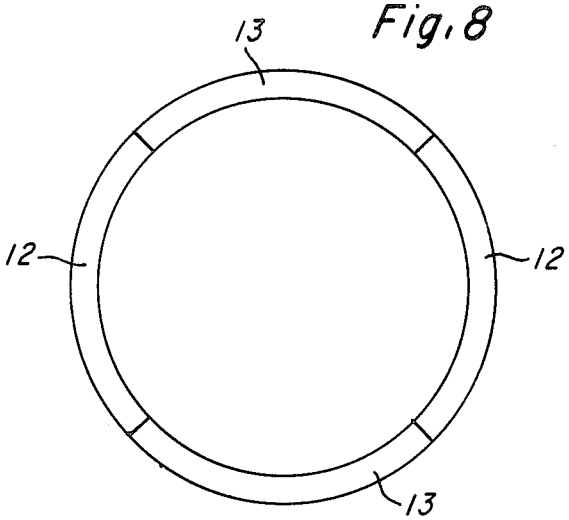

ARTICLE OF APPAREL

This invention relates to improvements in articles of clothing and the like, and more particularly to articles which are attachable/detachable to apparel items such as athletic or casual shoes, shorts, sports shirts and the like.

Attachable/detachable enclosures have heretofore been known, illustrative of which are those disclosed in U.S. Pat. Nos. 3,611,444 granted to C. T. Rector on Oct. 12, 1971 and 3,631,613 granted to Charles C. Brettell on Jan. 4, 1972. In the former Patent, there is illustrated a rectangular shaped detachable pocket having a pair of substantially parallel side panels peripherally joined with a substantially continuous seam and having a diagonal slit formed through one side panel, which panel has an exterior woolly surface adapted for engagement with a mating hooked fabric on the article to which the pocket is to be affixed. The slit is provided as an aperture through which access can be had to the interior of the pocket; and as the woolly surface adapted for engagement with the support is on the same panel as the slit, attachment of the pocket obscures the slit from view, the remaining, or non-woolly panel being exposed.

While the foregoing provides a useful solution to a need for a detachable pocket, with particular utility in the field of diving, it appears to be somewhat limited in its applicability and styling potential. Moreover, there are occasions when greater versatility is highly desirable and may be the factor that results in widespread popularity or acceptance of the item. Accordingly, there has been a continued need for detachable items that find a greater variety of applicability to apparel and greater versatility in appearance.

Accordingly, it is one general object of this invention to provide an improved and more versatile attachable/-detachable article such as a pocket.

It is another object of the invention to render the geometries of the article such that positioning for attachment is much less critical.

It is still another object of the invention to improve versatility of use of the article and to provide attractive ornamentation.

Accordingly, in accordance with one feature of the invention, the preferred embodiment is configured in a generally circular geometry, thereby rendering less critical (or immaterial) the rotational positioning of the article upon its support.

In accordance with another feature of the invention, attachment material of like type is positioned in corresponding positions on both major surfaces of the article, thereby making provision for attachment of either side to the support.

In accordance with still another feature of the invention, a detachable cover is provided for attachment to the exposed side when the article is attached to the main support and/or to the exposed location on the support when the article is removed, thereby facilitating ornamentation, camouflage, cover or concealment at the option of the user.

In accordance with still another feature of the invention, provision is made for attachment of a detachable cover to both sides of the article when it is removed from its support, thereby improving appearance and facilitating independent use of the article by itself.

These and other objects and features of the invention will be apparent from the following preferred embodiment, by way of example, with reference to the drawing in which:

FIG. 1 is a side elevation view illustrating an athletic shoe with the detachable article hereof in position thereupon;

FIG. 2 is a front elevation view of the detachable article in detached condition;

FIG. 3 is a rear elevation view of the detachable article in detached condition;

FIG. 4 is a side elevation view of the detachable article in detached condition;

FIG. 5 is a front elevation view of an ornamental cover suitable for positioning upon the detachable article;

FIG. 6 is a front elevation view of an alternative ornamental cover suitable for positioning upon the detachable article;

FIG. 7 is a side view of the ornamental covers of FIGS. 5 and 6; and FIG. 8 is a rear view of the ornamental covers of FIGS. 5, 6 and 7.

Now turning to the drawing, and more particularly to FIG. 1 thereof, it will be seen that therein illustrated is a conventional athletic shoe 1 on the side of which is attached detachable pocket 2. In this figure, detachable pocket 2 is shown with a plain cover 3, although, as will be described in detail in connection with FIGS. 2–7, it could be ornamental or of a nature such that it blends in with the background and provides a partial camouflage. Although not depicted, a mating portion of the surface of the side of the shoe (behind the pocket in FIG. 1) is provided with a surface comprising a plurality of tiny hooks of the type known as Velcro so as to provide for engagement with corresponding woolly surfaces disposed on both major faces of the detachable pocket 2. Thus, as will be evident from the following description, the pocket may either be attached (as shown), or the cover 3 may be removed and the pocket turned over and attached. Since the woolly surfaces are in corresponding positions on both sides, the cover then may be attached and the appearance then be as shown in FIG. 1.

Although in the following description, the inventions will be illustrated as having hooks on the support and the corresponding woolly surfaces on the front and rear parts of the article, it will be evident to one skilled in the art that the converse could be employed. In other words, the wooly surfaces could be on the support, and the corresponding hooks could be on the article. Moreover, as described in connection with FIG. 8, the surfaces could be comprised of combinations of both.

To facilitate understanding of the foregoing description, reference is now made to FIGS. 2–4 wherein there is described the preferred embodiment of the inventive pocket. There, it will be observed, is a member which is essentially circular in geometry. As seen in FIG. 4, the pocket is similar to a closed cylinder, with back wall 4, front wall 5 and side wall 6. These walls may be made of any suitable material such as fabric or composition, but preferably are of durable material that has the ability to flex so as to facilitate provision of an opening 7 through which items to be stored can be inserted and removed. Although other types of closures may be employed, a conventional zipper 8 is depicted as being the preferred way to secure the opening.

Also depicted in FIGS. 2–4 are two juxtaposed annuli 9 and 10 each comprising woolly material adapted for engagement with the aforementioned Velcro hooks. These annuli are in axial alignment so as to facilitate the attachment of either side of the pocket to the mating hooks positioned on the support (e.g., shoe 1 of FIG. 1).

The front wall 5, back wall 4 and side wall 6 may be fastened together by stitching or any other means known in the art, and the zipper 8 may be secured within opening 7 in like manner.

Now turning to FIGS. 5–8, it will be seen that they depict thin covers which may be affixed to either the back 4 or the front 5, depending on which is not in engagement with the shoe or other support. Moreover, if the pocket member is to be stored or carried other than in mating engagement with a support, covers such as those depicted in FIGS. 5–8 can be installed on both exposed surfaces, thereby protecting the woolly surfaces 9 and 10 while at the same time providing for pleasing ornamentation. Moreover, if desired, such covers may be comprised of material of a type that provides a maximum of blend with the attachment background (e.g., the side of the shoe), thereby rendering the pocket maximally inconspicuous (camouflage). Similarly, the cover(s) may be of plain material or of matching or contrasting color.

Now returning again to FIGS. 5–8, it will be observed that there are portrayed two examples of decorative covers that may be attractive to uers. FIG. 5 illustrates the capital letters "O" and "U" which would denote the University of Oklahoma, and the example of FIG. 6 illustrates the capital letters "T" and "T" superimposed partly one upon the other in the fashion sometimes seen in connection with Texas Technological University. Of course, these are presented merely as illustrative examples, and it will be evident that many other decorative configurations may be employed. These may encompass letters, figures, color patterns, pictorial views and the like, or combinations thereof.

FIGS. 7 and 8 depict, respectively, the side view and the rear view of the covers of FIGS. 5 and 6. There, it will be observed, is a front surface 11 on the reverse side of which is disposed an annulus containing alternating segments of Velcro type hooks 12 and woolly material 13 arranged adjacent the periphery in geometries corresponding to those of the woolly annuli 9 and 10 of FIGS. 2 and 3. By including segments of wool and hooks both, provision is made for attachment to either the material on the support (e.g., shoe, shorts, shirt) or to the article, it being contemplated that one of the features of versatility is the fact that when the article is removed, one of the covers may be attached in its place. However, these annuli may comprise hooks only if the decorative covers are to be attached only to the article.

It will now be observed that the inventions hereof provide versatility far greater than that of the prior art to which reference is made above, permitting attachment of either major side of the pocket to its support, providing for ornamentation, cover or concealment, providing for ease of change of ornamentation to customize the pocket for the user, for permitting attachment of one of the covers directly on the supporting member when the article (pocket) is removed therefrom, and further providing for an attractive object for use independent of a supporting article.

While the inventions hereof have been described by way of example of preferred embodiments, it will be evident that other adaptations and modifications may be employed without departing from the spirit and scope thereof. For example, instead of a zipper closure, other mating closures could be employed. Moreover, instead of a circular or annular configuration, the article could be polygonal.

The terms and expressions employed herein have been used as terms of description and not of limitation; and thus, there is no intent of excluding equivalents, but on the contrary it is intended to cover any and all equivalents that may be employed without departing from the spirit and scope of the inventions.

What is claimed is:

1. A detachable pocket comprising a cylindrically shaped wall member, a front circular end and a back circular end joined to said wall member to form a closed cylindrically shaped enclosure, said front circular end having an opening therein to provide access to the interior of said enclosure, and two rings of attachment material severally disposed in juxtaposed relationship upon the exterior surfaces of said front circular end and said back circular end.

2. A detachable pocket according to claim 1 in which said attachment material is a hooked substance adapted for fastening to corresponding woolly material.

3. A detachable pocket according to claim 1 in which said attachment material is a woolly substance adapted for fastening to corresponding hooked material.

4. A detachable pocket according to claim 1 in which said opening is fitted with a zipper for opening and closure.

5. A detachable pocket according to claim 1 further including a thin circular detachable cover having a diameter substantially that of said front circular end and having a narrow band of attachment material thereupon adjacent the periphery thereof for engagement with either of said two rings of attachment material thereby to provide for attachment/detachment thereof to either said front circular end or said back circular end essentially in axial alignment therewith.

6. A detachable pocket according to claim 3 further including a thin circular detachable cover having a diameter substantially that of said front circular end and having a narrow band of attachment material including hooked material thereupon adjacent the periphery thereof for engagement with either of said two rings of woolly material thereby to provide for attachment-/detachment thereof to either said front circular end or said back circular end essentially in axial alignment therewith.

7. A detachable pocket according to claim 6 in which said narrow band of attachment material upon said circular cover includes alternating segments of hooked and woolly material.

8. In combination, an article of clothing having thereon a thin annulus of attachment material and a detachable pocket comprising an annular-shaped wall member, a front end and a back end each of annular shape corresponding to that of said thin annulus, said front end and said back end being joined to said wall member adjacent the edges thereof thereby to form an enclosure of annular cross section, said front end having an opening therein to provide access to the interior of said enclosure, and two annuli of attachment material severally disposed in juxtaposed relationship upon the exterior surfaces of said front and said back, thereby to provide for attachment of said pocket to said thin annulus of attachment material at either said front or said back.

9. The combination of claim 8 further including a thin circular detachable cover having an annular shape corresponding to that of said front and back ends and having a narrow band of attachment material thereon adjacent the periphery thereof for engagement with either of said two annuli of attachment material thereby to provide for attachment/detachment thereof to either said front end or said back end essentially in alignment therewith.

10. A detachable pocket comprising a wall member, a front end and a back end joined to said wall member to form a closed cylindrically shaped enclosure, said front end having a closable opening therein to provide access to the interior of said enclosure, and two strips of attachment material severally disposed in juxtaposed relationship upon the exterior surfaces of said front end and said back end.

* * * * *